US005584253A

United States Patent [19]

Stranford

[11] Patent Number: 5,584,253

[45] Date of Patent: Dec. 17, 1996

[54] TELEVISION SUPPORTED SHELF

[76] Inventor: James A. Stranford, Road #1, Box 151A, Clymer, Pa. 15728

[21] Appl. No.: 488,481

[22] Filed: Jun. 8, 1995

[51] Int. Cl.[6] ..... A47B 23/00

[52] U.S. Cl. ..... 108/42; 108/44; 108/90

[58] Field of Search ..... 108/42, 90, 46, 108/47, 44, 45, 157, 159; 248/188; 211/86, 88, 90

[56] References Cited

U.S. PATENT DOCUMENTS

| | | | |
|---|---|---|---|
| 2,657,964 | 11/1953 | Watrous | 108/157 |
| 2,695,712 | 11/1954 | Kolander | 108/46 X |
| 3,930,701 | 1/1976 | Otakie | 108/42 X |
| 3,983,821 | 10/1976 | Kearns | 108/42 |
| 4,577,788 | 3/1986 | Richardson | 108/44 X |
| 4,870,907 | 10/1989 | McKee | 108/42 |

FOREIGN PATENT DOCUMENTS

| | | | |
|---|---|---|---|
| 615114 | 1/1949 | United Kingdom | 108/47 |

*Primary Examiner*—Jose V. Chen

[57] ABSTRACT

A shelf for supporting objects relative to a television. The device includes a shelf panel positionable upon a front portion top surface of a television so as to project rearwardly therefrom. A support assembly depends from the shelf panel to engage a rear portion top surface of the television to maintain the shelf panel in a horizontal orientation for the supporting of objects thereon.

6 Claims, 4 Drawing Sheets

FIG 3
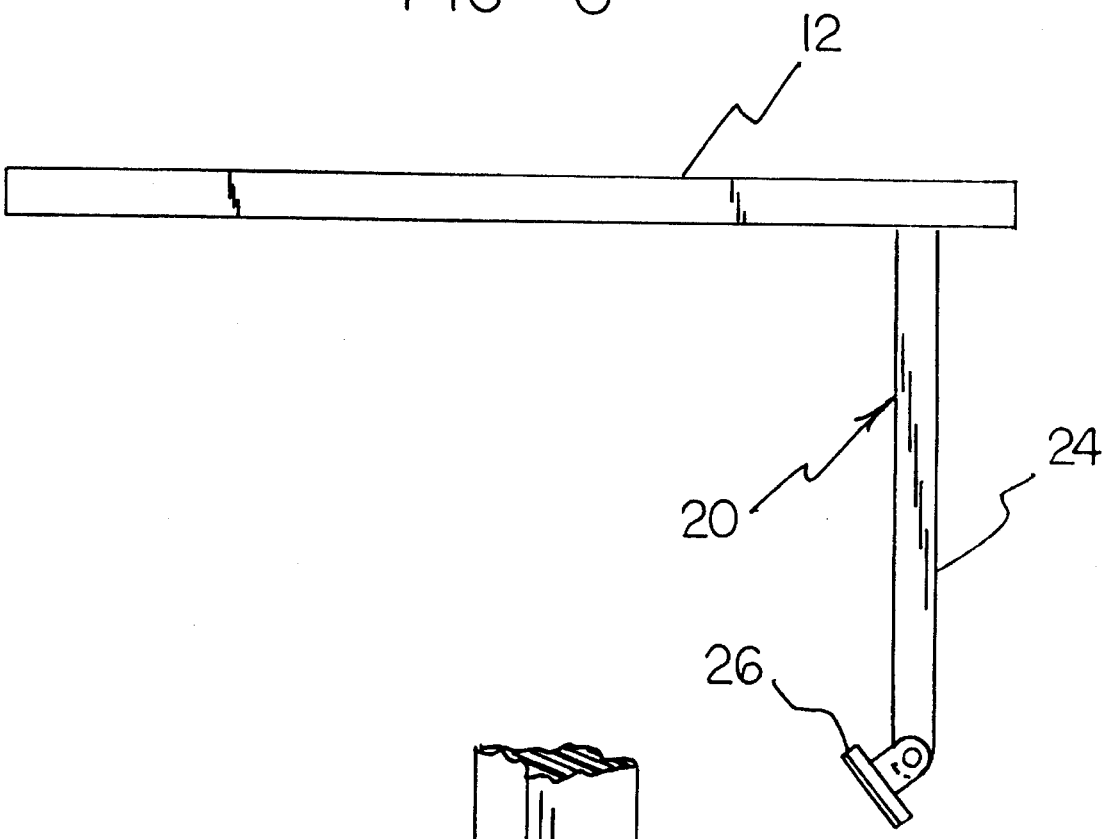
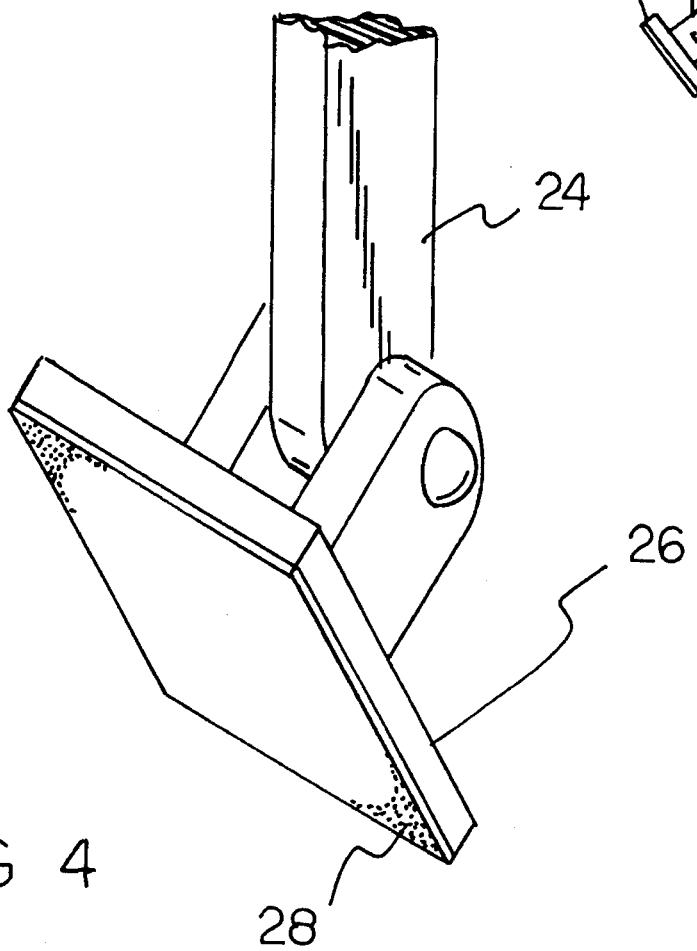
FIG 4

FIG 6
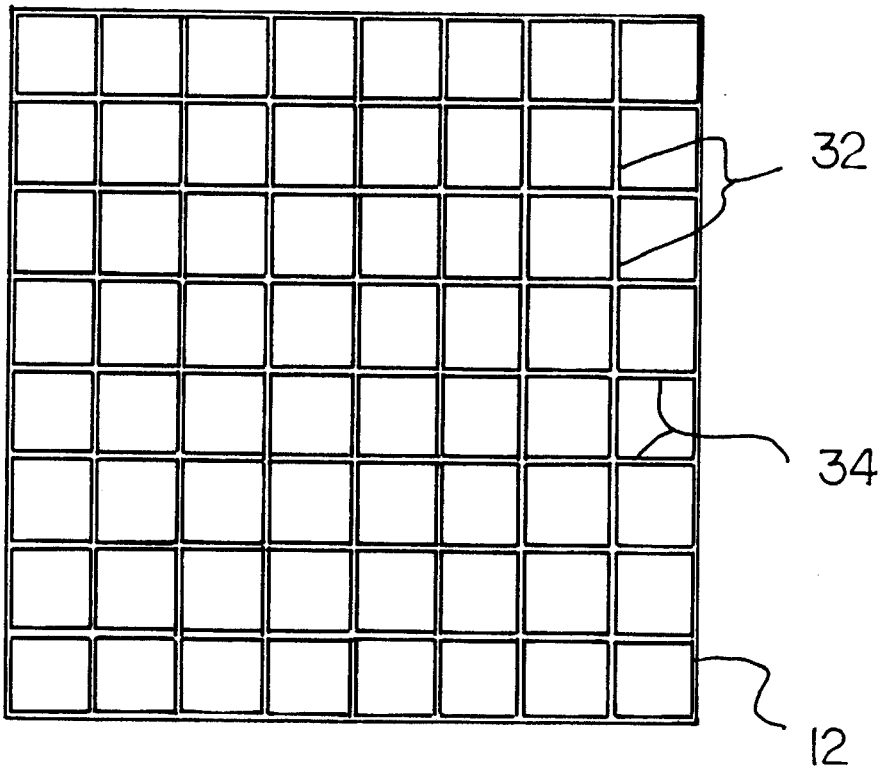
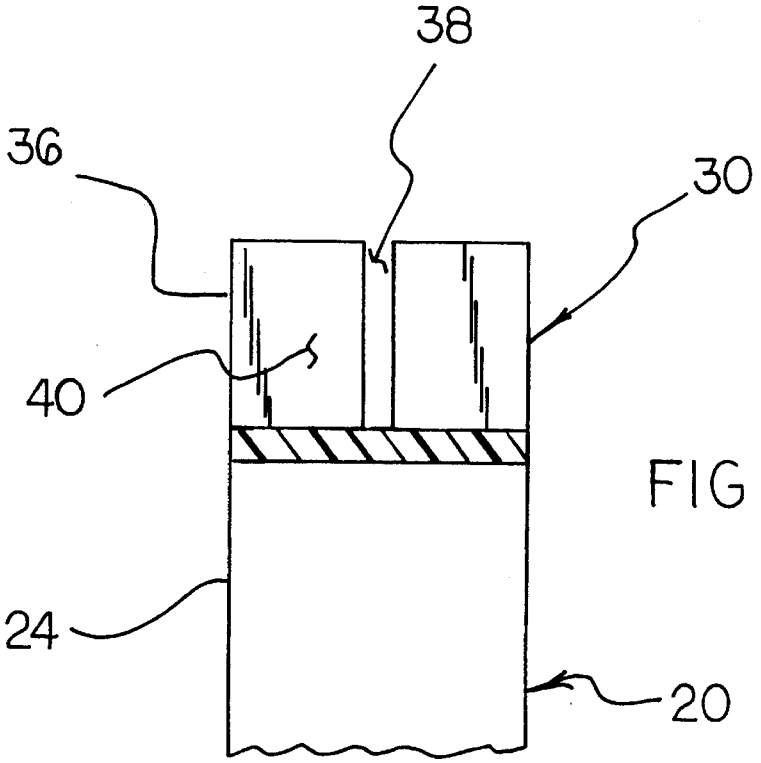
FIG 7

TELEVISION SUPPORTED SHELF

BACKGROUND OF THE INVENTION

1. Field of the Invention

The present invention relates to shelf structures and more particularly pertains to a television supported shelf for supporting objects relative to a television.

2. Description of the Prior Art

The use of shelf structures is known in the prior art. More specifically, shelf structures heretofore devised and utilized are known to consist basically of familiar, expected and obvious structural configurations, notwithstanding the myriad of designs encompassed by the crowded prior an which have been developed for the fulfillment of countless objectives and requirements.

Known prior art shelf structures include U.S. Pat. No. 5,240,119; U.S. Pat. No. 5,216,211; U.S. Pat. No. 5,354,125; U.S. Pat. No. 5,188,246; U.S. Pat. No. Des. 292,254; and U.S. Pat. No. Des. 335,051.

While these devices fulfill their respective, particular objectives and requirements, the aforementioned patents do not disclose a television supported shelf for supporting objects relative to a television which includes a shelf panel positionable upon a front portion top surface of a television so as to project rearwardly therefrom, and a support assembly depending from the shelf panel for engaging a rear portion top surface of television to maintain the shelf panel in a horizontal orientation for supporting of objects thereon.

In these respects, the television supported shelf according to the present invention substantially departs from the conventional concepts and designs of the prior art, and in so doing provides an apparatus primarily developed for the purpose of supporting objects relative to a television.

SUMMARY OF THE INVENTION

In view of the foregoing disadvantages inherent in the known types of shelf structures now present in the prior art, the present invention provides a new television supported shelf construction wherein the same can be utilized for supporting objects upon a top surface of a television. As such, the general purpose of the present invention, which will be described subsequently in greater detail, is to provide a new television supported shelf apparatus and method which has many of the advantages of the shelf structures mentioned heretofore and many novel features that result in a television supported shelf which is not anticipated, rendered obvious, suggested, or even implied by any of the prior art shelf structures, either alone or in any combination thereof.

To attain this, the present invention generally comprises a shelf for supporting objects relative to a television. The inventive device includes a shelf panel positionable upon a front portion top surface of a television so as to project rearwardly therefrom. A support assembly depends from the shelf panel to engage a rear portion top surface of the television to maintain the shelf panel in a horizontal orientation for the supporting of objects thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new television supported shelf apparatus and method which has many of the advantages of the shelf structures mentioned heretofore and many novel features that result in a television supported shelf which is not anticipated, rendered obvious, suggested, or even implied by any of the prior art tool guides, either alone or in any combination thereof.

It is another object of the present invention to provide a new television supported shelf which may be easily and efficiently manufactured and marketed.

It is a further object of the present invention to provide a new television supported shelf which is of a durable and reliable construction.

An even further object of the present invention is to provide a new television supported shelf which is susceptible of a low cost of manufacture with regard to both materials and labor, and which accordingly is then susceptible of low prices of sale to the consuming public, thereby making such television supported shelves economically available to the buying public.

Still yet another object of the present invention is to provide a new television supported shelf which provides in the apparatuses and methods of the prior art some of the advantages thereof, while simultaneously overcoming some of the disadvantages normally associated therewith.

Still another object of the present invention is to provide a new television supported shelf for supporting objects relative to a television.

Yet another object of the present invention is to provide a new television supported shelf which includes a shelf panel positionable upon a front portion top surface of a television so as to project rearwardly therefrom, and a support assembly depending from the shelf panel for engaging a rear portion top surface of television to maintain the shelf panel in a horizontal orientation for supporting of objects thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevation view thereof.

FIG. 4 is an enlarged isometric illustration of a portion of the invention.

FIG. 6 is a bottom plan view of a shelf panel comprising a portion of the present invention as viewed from line 6—6 of FIG. 5.

FIG. 7 is a cross sectional view taken along line 7—7 of FIG. 5.

DESCRIPTION OF THE PREFERRED EMBODIMENT

Figure 1:
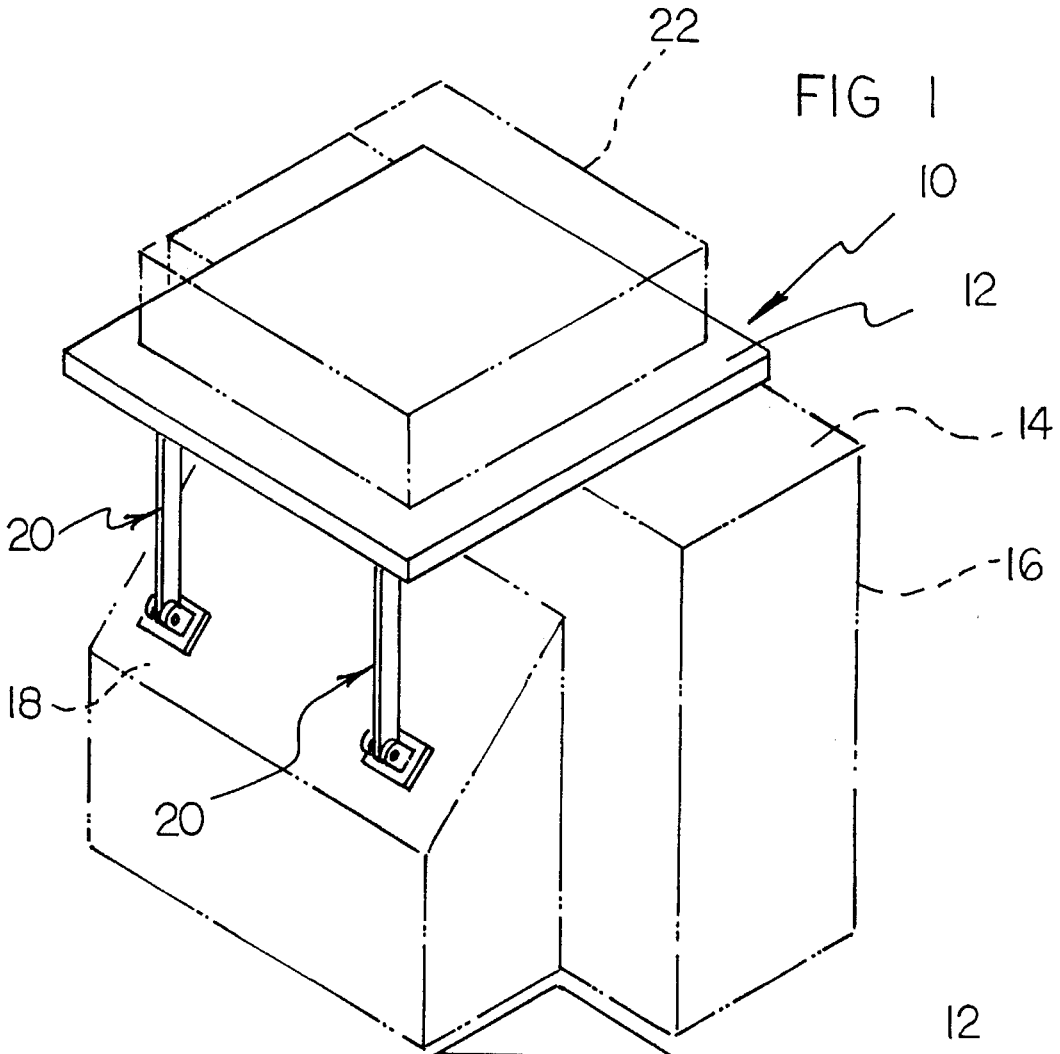
FIG. 1 is an isometric illustration of a television supported shelf according to the present invention in use.

With reference now to the drawings, and in particular to FIGS. 1–7 thereof, a new television supported shelf embodying the principles and concepts of the present invention and generally designated by the reference numeral 10 will be described.

More specifically, it will be noted that the television supported shelf 10 comprises a shelf panel 12 positionable upon a front portion top surface 14 of a television 16 substantially as shown in FIG. 1 of the drawings. The shelf panel 12 is dimensioned so as to extend rearwardly beyond and off the front portion top surface 14 of the television 16 so as to reside in a spaced orientation relative to a rear portion top surface 18 of the television. A support means 20 is coupled to a lower surface of the shelf panel 12 and depends therefrom for engaging the rear portion top surface 18 of the television 16 to support the shelf panel 12 in a horizontal orientation such that objects can be positioned thereon. By this structure, an individual can securely support an object such as a VCR 22 upon a television 16.

Figure 2:
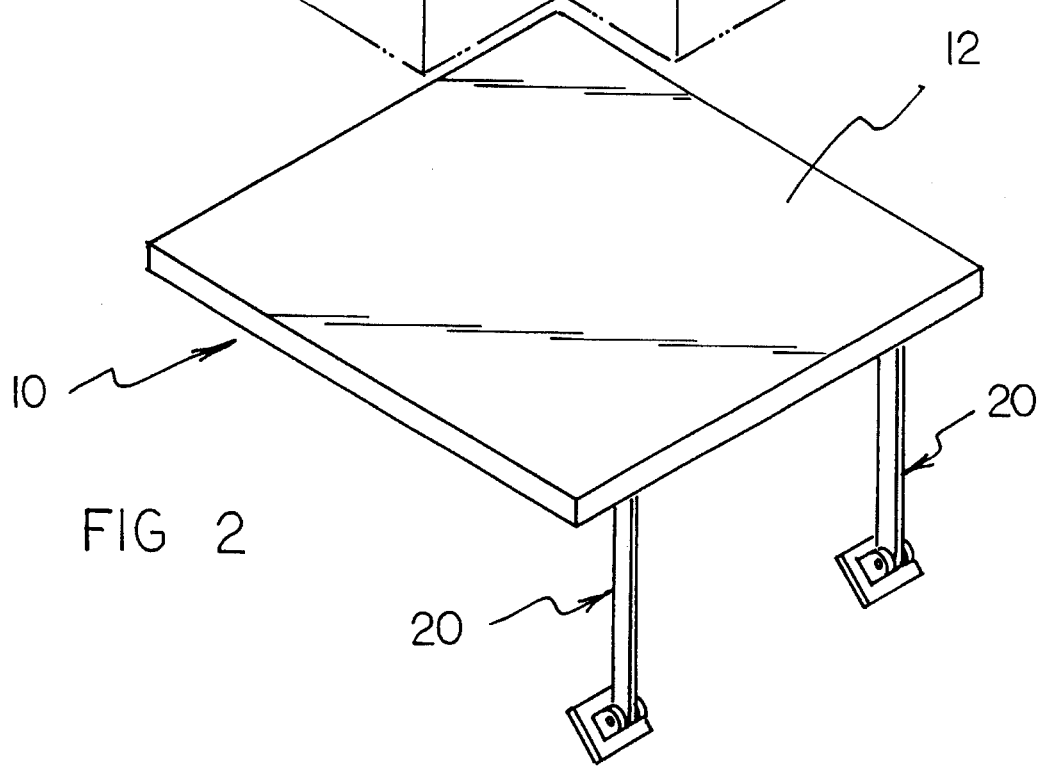
FIG. 2 is an isometric illustration of the present invention, per se.

Referring now to FIGS. 2 through 4 of the drawings wherein the present invention 10 is illustrated in detail, it can be shown that the support means 20 of the present invention 10 preferably comprises a stanchion 24 coupled to the lower surface of the shelf panel 12 and projecting substantially orthogonally downwardly therefrom. An engaging foot 26 is pivotally mounted to a lower end of the stanchion and includes a adhesive pad 28 coupled thereto which can be adhesively secured to the rear portion top surface 18 of the television 16. By this structure, the support means 20 operates to support a rearward edge of the shelf panel 12 relative to the rear portion top surface 18 of the television 16 to preclude a pivoting of the shelf panel 12 from the front portion top surface 14 upon which the forward portion of the shelf panel is residing.

Figure 5:
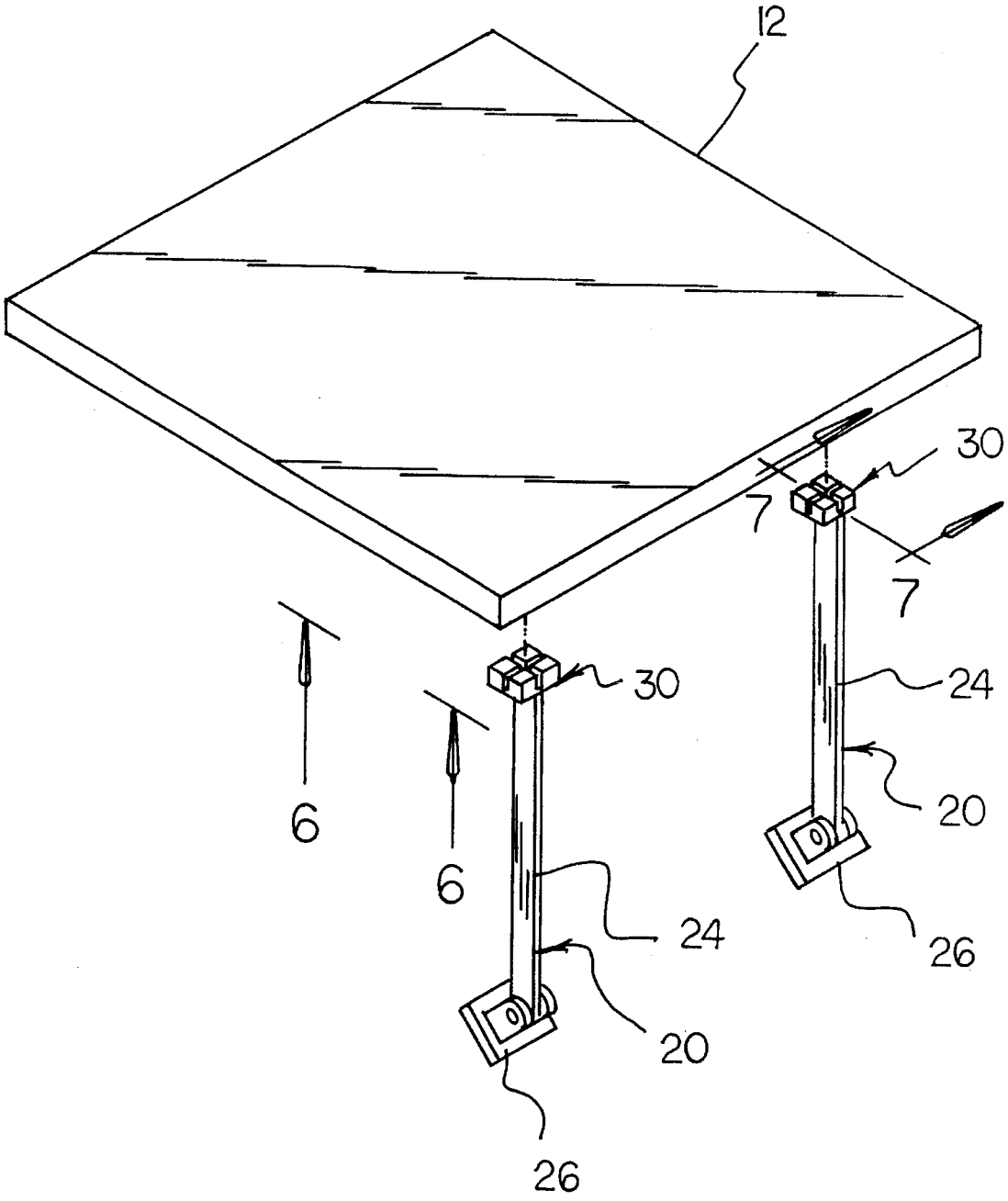
FIG. 5 is an exploded isometric illustration of the invention.

Referring now to FIGS. 5 through 7, it can be shown that the stanchion 24 of the support means 20 is preferably mounted to the lower surface of the shelf panel 12 by an adjustable coupling means 30 mounted to an upper end of the stanchion 24 for adjustably securing the upper end of the stanchion to the lower surface of the shelf panel 12. To this end, and as shown in FIGS. 6 and 7, the lower surface of the shelf panel 12 is preferably shaped so as to define a matrix of intersecting ribs including a first plurality of parallel ribs 32 and a second plurality of parallel ribs 34 projecting from the lower surface of the shelf panel 12. The first plurality of parallel ribs 32 is oriented so as to extend substantially orthogonally relative to the second plurality of parallel ribs 34 so as to define the matrix of intersecting ribs as shown in FIG. 6 of the drawings. The adjustable coupling means 30, as shown in FIG. 7, further comprises a mounting head 36 secured to the upper end of the stanchion 24 of the support means 20. The mounting head 36 is shaped so as to define a matrix of intersecting grooves including a first receiving groove 38 and a second receiving groove 40 directed into the mounting head 36. The first receiving groove 38 is oriented so as to extend substantially orthogonally relative to the second receiving groove 40, whereby the mounting head 36 can be engaged to intersecting ribs 32 and 34 of the shelf panel 12. By this structure, the adjustable coupling means 30 permits intersecting ribs 32 and 34 of the shelf panel 12 to be inserted into the intersecting receiving grooves 38 and 40 of the mounting head 36, whereby frictional engagement between the exterior surfaces of the ribs and the interior surfaces of the receiving grooves operates to secure the support means 20 relative to the shelf panel 12 so as to project substantially orthogonally therefrom as shown in FIG. 3 of the drawings. Preferably, the present invention 10 utilizes a pair of support means 20 positioned in a substantially spaced and parallel orientation as shown in FIGS. 1 and 2 of the drawings.

In use, the television supported shelf 10 according to the present invention can be easily utilized for supporting objects such as a VCR 22 relative to a television 16, as shown in FIG. 1 of the drawings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A television supported shelf comprising:

a shelf panel positionable upon a front portion top surface of a television, the shelf panel being dimensioned so as to extend rearwardly beyond and off the front portion top surface of the television so as to reside in a spaced orientation relative to a rear portion top surface of the television;

a support means coupled to a lower surface of the shelf panel and depending therefrom for engaging the rear portion top surface of the television to support the shelf panel in a horizontal orientation, the support means being adjustably coupled to the lower surface of the shelf panel, the support means comprises a stanchion adjustably coupled to the lower surface of the shelf panel and projecting downwardly therefrom, an engaging foot mounted to a lower end of the stanchion, the engaging foot being pivotally mounted to the lower end of the stanchion, the engaging foot including an adhesive pad coupled thereto which can be adhesively secured to the rear portion top surface of the television, the stanchion being adjustably mounted to the lower surface of the shelf panel by an adjustable coupling means mounted to an upper end of the stanchion for adjustably securing the upper end of the stanchion to the lower surface of the shelf panel, the lower surface of the shelf panel being shaped so as to define a matrix of intersecting ribs, a mounting head secured to the upper end of the stanchion of the support means, the mounting head being shaped so as to define a matrix of intersecting grooves cooperatively engageable with the intersecting ribs of the shelf panel.

2. The television supported shelf of claim 1, wherein the matrix of intersecting ribs includes a first plurality of parallel ribs and a second plurality of parallel ribs projecting from the lower surface of the shelf panel, the first plurality of parallel ribs being oriented so as to extend substantially orthogonally relative to the second plurality of parallel ribs so as to define the matrix of intersecting ribs.

3. The television supported shelf of claim 2, wherein the matrix of intersecting grooves of the mounting head includes a first receiving groove and a second receiving groove directed into the mounting head, the first receiving groove being oriented so as to extend substantially orthogonally relative to the second receiving groove.

4. A television supported shelf comprising:

a television having a front portion top surface and a rear portion top surface;

a shelf panel positionable upon the front portion top surface of a television, the shelf panel being dimensioned so as to extend rewardly beyond and off the front portion top surface of the television so as to reside in a spaced orientation relative to the rear portion top surface of the television;

a support means coupled to a lower surface of the shelf panel and depending therefrom for engaging the rear portion top surface of the television to support the shelf panel in a horizontal orientation, the support means being adjustably coupled to the lower surface of the shelf panel, the support means comprises a stanchion adjustably coupled to the lower surface of the shelf panel and projecting downwardly therefrom, an engaging foot mounted to a lower end of the stanchion, the engaging foot being pivotally mounted to the lower end of the stanchion, the engaging foot including an adhesive pad coupled thereto which can be adhesively secured to the rear portion top surface of the television, the stanchion being adjustably mounted to the lower surface of the shelf panel by an adjustable coupling means mounted to an upper end of the stanchion for adjustably securing the upper end of the stanchion to the lower surface of the shelf panel, the lower surface of the shelf panel being shaped so as to define a matrix of intersecting ribs, a mounting head secured to the upper end of the stanchion of the support means, the mounting head being shaped so as to define a matrix of intersecting grooves cooperatively engageable with the intersecting ribs of the shelf panel.

5. The television supported shelf of claim 4, wherein the matrix of intersecting ribs includes a first plurality of parallel ribs and a second plurality of parallel ribs projecting from the lower surface of the shelf panel, the first plurality of parallel ribs being oriented so as to extend substantially orthogonally relative to the second plurality of parallel ribs so as to define the matrix of intersecting ribs.

6. The television supported shelf of claim 5, wherein the matrix of intersecting grooves of the mounting head includes a first receiving groove and a second receiving groove directed into the mounting head, the first receiving groove being oriented so as to extend substantially orthogonally relative to the second receiving groove.

* * * * *